United States Patent [19]

Stanton

[11] 4,194,648

[45] Mar. 25, 1980

[54] GOLF PUTTING TRAINING DEVICE

[76] Inventor: Robert Stanton, Rte. 44, Millbrook, N.Y. 12545

[21] Appl. No.: 905,155

[22] Filed: May 12, 1978

[51] Int. Cl.[2] ..... A63B 57/00

[52] U.S. Cl. ..... 221/299; 273/192; 273/201

[58] Field of Search ..... 221/251, 298, 299; 273/192, 201, 32 D

[56] References Cited

U.S. PATENT DOCUMENTS

| | | | |
|---|---|---|---|
| 2,123,195 | 7/1938 | Middleton | 273/201 |
| 2,789,824 | 4/1957 | Willcox | 273/201 |
| 3,458,204 | 7/1969 | Wilson | 273/201 |
| 4,082,287 | 4/1978 | Berkey | 273/192 |

*Primary Examiner*—Stanley H. Tollberg

[57] ABSTRACT

A vertical wall surface, providing a guide for a parallel putting stroke, is provided with an opening at the midpoint through which individual golf balls are to be ejected onto a putting surface prior to each stroke. A base, top, back and end walls enclose storage for a plurality of golf balls. A bar on the top of the device, which can be depressed by a putter, actuates a release mechanism to permit a single ball to pass through the opening in the vertical wall.

4 Claims, 4 Drawing Figures

GOLF PUTTING TRAINING DEVICE

BACKGROUND OF THE INVENTION

1. Field of the Invention

The subject invention relates to a golf putting-stroke training device, and more particularly, to a device which provides storage of a plurality of golf balls for release, one at a time, to a position on a putting surface for stroking by a putter along a vertical wall of the device.

2. Description Of The Prior Art

A large number of putting-stroke training devices exist in the prior art which provide a longitudinal surface creating a guide for achieving, through practice, a putting stroke which follows a straight line. With one exception, the prior art training devices require the user to obtain a ball from another source and place it in position for stroking.

U.S. Pat. No. 3,510,136 discloses a device for practicing golf strokes providing a guide surface for the putter stroke. One embodiment discloses a series of tracks on top of the device for placing a plurality of golf balls. A mechanism is disclosed which requires a user to manipulate a swinging mechanism for causing one ball to be released from the track and be guided by the swinging mechanism to a position for stroking. The device disclosed does not provide for transportation and storage of the mechanism, when not in use, with golf balls contained therein, and appears to require a fair amount of attention to manipulate the ball release mechanism for placing a ball in position to be stroked.

SUMMARY OF PRESENT INVENTION

It is an object of the present invention to provide a putting training device which includes internal storage of a plurality of golf balls which permits storage and transport of the device, with golf balls.

It is another object of the present invention to provide a golf putting training device with storage of a plurality of golf balls and an easily operated actuator mechanism for releasing a single golf ball for stroking by a user.

A further object is to provide a golf putting training device with internal storage of golf balls and an actuator mechanism for releasing a single ball, in which means are provided for insuring that only a single ball is ejected from the device each time the ball release mechanism is actuated.

These and other objects are achieved in a golf putting training device which includes a tubular storage for a plurality of golf balls behind a vertical, longitudinal wall surface which provides a guide for achieving a parallel golf putting stroke. The tubular storage includes an inlet for the golf balls, and an outlet which communicates with an opening in the vertical wall surface.

An actuator, which can be depressed by the golf putter, is associated with a guide between the storage tube outlet and vertical wall opening. The actuator includes a spring biased retaining means which normally prevents passage of a ball from the storage tube to the vertical wall opening until depressed by a golf putter. A single ball will pass through the vertical wall opening, and at the same time, the actuator prevents a next succeeding ball from being allowed to pass through the opening. When the actuator is released, the next succeeding ball is then positioned behind the retaining means for release when desired. The storage device is enclosed behind the vertical wall, and the inlet for golf balls into the storage tube may be closed to provide for transport and storage of the device, with golf balls, when not in use.

DETAILED DESCRIPTION OF THE INVENTION

Figure 1:
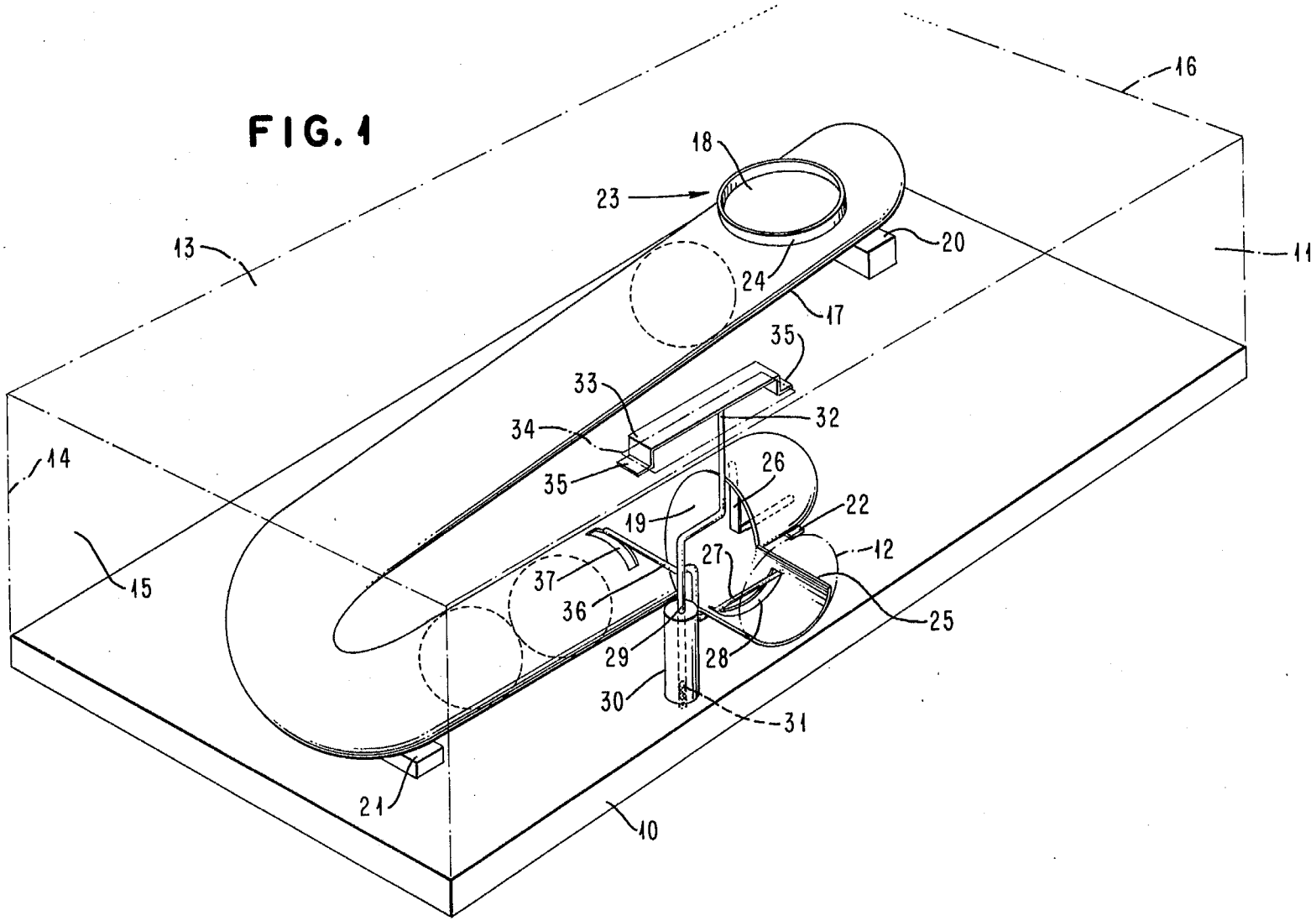
FIG. 1 is a perspective view of a putting training device in accordance with the invention.

In FIG. 1, the putting training device is shown in perspective. The device includes a base 10 and shown in phantom outline, a vertical wall 11, with an opening 12 of a size sufficient to allow a golf ball to pass therethrough, and positioned at the midpoint of the vertical wall ends. Associated with the base 10 and vertical wall 11, are a top 13, back 14, and end walls 15 and 16 providing an enclosure. Within the enclosure, and behind the vertical wall 11, is storage for a plurality of golf balls. The storage is comprised of a tube 17 having an inlet 18 and an outlet 19. Attached to the base 10 are mounting blocks 20, 21 and 22 for the storage tube 17 having a thickness which provides an incline from the inlet 18 to the outlet 19 of the storage tube 17. With a desire to provide storage of a dozen balls in the tube 17, and maintain an overall length of the training device of approximately 24 inches, a U-shaped configuration of the storage tube 17 has been provided.

The diameter of the storage tube 17, inlet 18, outlet 19, and opening 12 in the vertical wall 11 permit passage of golf balls. An opening 23 in the top 13 communicates with the inlet 18 of the storage tube 17. A suitable cowling 24 is provided, in view of the incline, to insure that golf balls inserted in the opening 23 communicate directly with the inlet 18 of the storage tube 17.

To permit passage of a golf ball from the outlet 19 of the storage tube 17 to the opening 12 in the vertical wall 11, a generally U-shaped ball guide 25 is provided. The ball guide 25 may be formed from that portion of the storage tube 17 which has been cut out to form the outlet 19. Another cut out portion 26 of the storage tube 17 is bent to a vertical position to provide a stop for golf balls to position them at the outlet 19.

The ball guide 25 is inclined from the outlet 19 to the opening 12 to permit a ball to roll from the outlet 19 to the opening 12. An actuator, in its normal position, includes a horizontal ball-retaining arm 27 positioned beneath the guide 25, which normally extends above the upper surface of the guide 25 through a slot 28 provided in the guide 25. The horizontal arm 27 is attached to a vertical rod 29 which is positioned within a cylindrical mount 30 mounted in the base 10. A coil spring 31 in the bottom of the cylinder 30 normally positions the arm 27 in such a manner that a ball is prevented from rolling from the outlet 19 to the opening 12. A further extension 32 to the rod 29, formed as shown, has attached to the top thereof, a putter depressable bar 33 which extends above the vertical wall 11, and through a suitable opening 34 in the top 13. Tabs 35 at either end of the bar 33 communicate with the underside of the top 13 to retain the entire actuator mechanism within the housing.

When the bar 33 is depressed by using a putter, the vertical rod 29 will be depressed against the bias spring 31 and lower the horizontal arm 27 below the upper surface of the guide 25, and permit a ball to roll from the outlet 19 to the opening 12 onto the putting surface.

If the bar 33 were depressed for too long a time, a next succeeding ball would be permitted through the opening 12. To prevent the next succeeding ball in the storage tube 17 from reaching outlet 12, a further retaining arm 36, attached to the rod 29 is provided. A slot 37 in the storage tube 17 receives the arm 36 in such a way that in the normal position, the arm 36 is above the inner surface of the storage tube 17. However, when the bar 33 is depressed to lower the arm 27, the further arm 36 is also lowered to a position below the inner surface of the storage tube 17, and blocks the next succeeding ball from reaching the outlet 19 until the actuator mechanism is released to its normal position.

Figure 2:
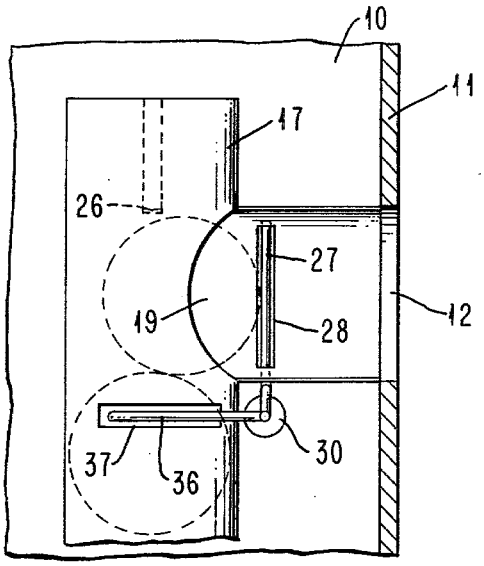
FIG. 2 is a plan view of a portion of the golf ball storage and actuator mechanism of FIG. 1 providing for release of a single golf ball from the storage tube.

FIG. 2 is a larger plan view of a portion of the device shown in FIG. 1 providing another view of the relationship of the actuator mechanism and storage tube. The same reference numbers have been utilized in FIG. 2 as utilized in FIG. 1. The combination of the vertical cut out portion 26 and the retaining arm 27 in the slot 28 combine to position a ball for release to the opening 12 in the vertical wall 11. When the actuator is depressed against the bias spring 31 in the cylinder 30, the retaining arm 27 will be lowered to permit passage of a ball from the outlet 19 along the guide 25 to the outlet 12. At the same time, the other retaining arm 36 will be lowered into the slot 37 and block a next succeeding ball from reaching the outlet 19.

Figure 3:
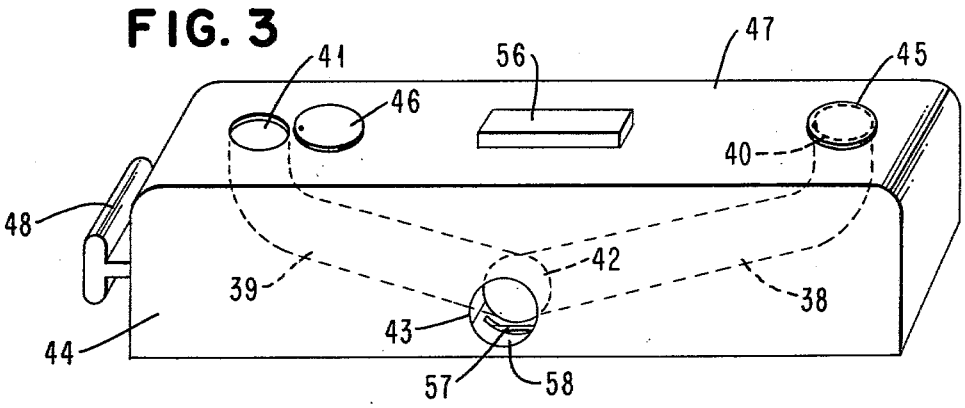
FIG. 3 is a perspective view of a golf putting training device in accordance with the present invention showing a further embodiment of the golf ball storage.

FIG. 3 depicts an alternate form of the putting training device in which the storage tube is changed from a U-shaped configuration shown in FIG. 1 to two separate storage tubes 38 and 39 each with an inlet 40 and 41, and which meet at a common outlet 42, which communicates with an opening 43 in the vertical wall 44. Depicted in FIG. 3, are two pivotedly mounted disks 45 and 46 on the top 47 of the device. Also shown is a handle 48 for carrying the putting device. Balls may be placed in the storage tubes 38 and 39, and the disks 45 and 46 pivoted to close the inlets 40 and 41. This permits transportation of the device by means of the handle 48 with storage of the golf balls in the tubes 38 and 39. A pivoting disk can also be placed over the opening 23 in the top 13 shown in FIG. 1.

Figure 4:
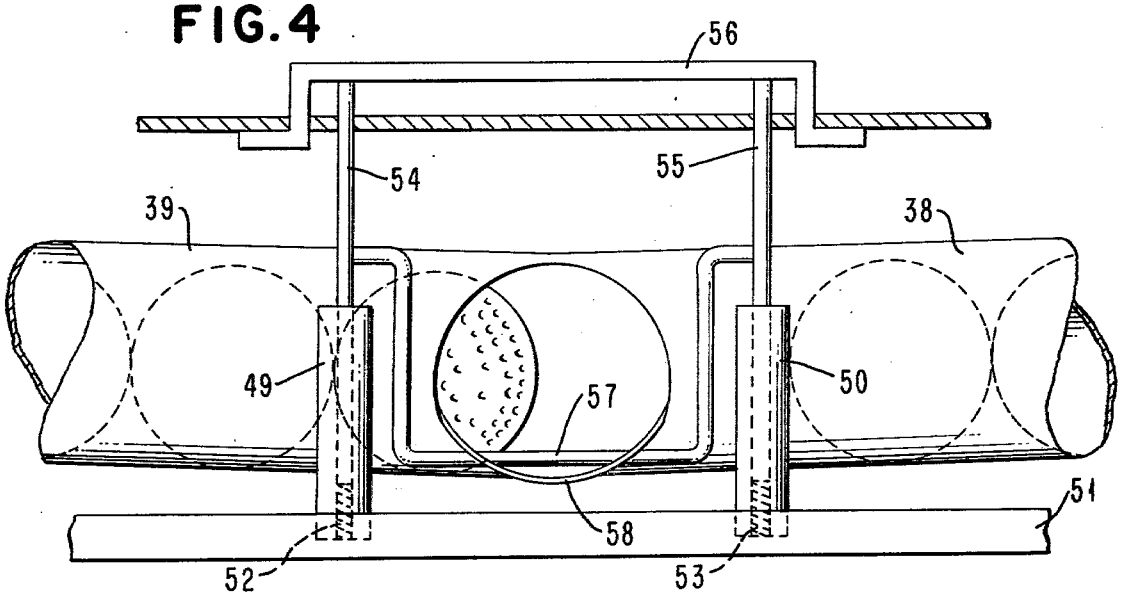
FIG. 4 shows an alternate form of the actuator mechanism for use with the embodiment shown in FIG. 3.

FIG. 4 is an elevation view of an actuator mechanism that can be implemented in the device shown in FIG. 3. A balanced actuator mechanism is shown in this particular embodiment, and includes two cylindrical members 49 and 50 inserted in a base 51. Each cylindrical tube has at the bottom thereof bias spring 52 and 53. Vertical rods 54 and 55 are attached to a depressing bar 56 which extends above the top 47. A retaining arm 57, in the normal position, extends above the surface of guide 58, and is attached to each of the rods 54 and 55. As in the mechanism shown in FIG. 1, when the bar 56 is depressed, the retaining bar 57 is lowered below the surface of the guide 58 to permit a ball to roll along the guide 58 from the outlet 43 to the opening 42 in the vertical wall.

Having thus described my invention, what I claim as new, and desire to secure by Letters Patent is:

1. A putting guide comprising:

a base and integral top and end walls, and front and back vertical walls, forming an enclosure for placement on a putting surface, said vertical front wall providing an elongated reference surface to guide a putter in a straight line and having a length coextensive with a putting stroke;

storage means within said enclosure for a plurality of golf balls, said vertical front wall including an opening of a diameter sufficient to allow a golf ball to pass there-through from said storage means to the putting surface, said enclosure having another opening cooperating with said storage means for placing golf balls in said storage means, and movable means for closing said another opening in said enclosure;

a guide, between said storage means and said opening in said vertical front wall having an upper surface for guiding a ball through said opening;

actuator means including retaining means, normally projecting above said upper surface of said guide to prevent passage of a ball to said opening in said vertical front wall, means extending through and above said top wall for depressing said retaining means to lower said retaining means to allow passage of a ball through said opening in said vertical front wall, and bias means for returning said retaining means to its normal position.

2. A putting guide in accordance with claim 1 wherein:

said storage means is comprised of;

an elongated tube having a diameter sufficient to allow passage of balls therethrough, said tube having an inlet and outlet for balls, and mounted on said base to provide an incline from said inlet to said outlet, said outlet communicating with said guide and said inlet communicating with said another opening in said enclosure, and including stop means to position a ball on the opposite side of said retaining means from said opening.

3. A putting guide in accordance with claim 2 wherein:

said elongated tube includes;

an opening on the top thereof, positioned between a ball at said outlet and the next succeeding ball in said tube; and said actuator means includes;

further retaining means, associated with said opening in said tube, normally positioned above the inner surface of said tube, and operable, when said actuator is depressed, to project below said inner surface of said tube to thereby prevent the next succeeding ball from moving to said outlet until said actuator is returned to its normal position by said bias means.

4. A putting guide in accordance with claim 1 wherein:

said enclosure includes a further opening and associated closing means; and said storage means is comprised of;

first and second elongated tubes having a diameter sufficient to allow passage of balls therethrough, each said first and second elongated tubes having an inlet for balls, each cooperating with said another opening and said further opening respectively, and a common outlet, said outlet communicating with said guide.

* * * * *